US011808150B2

(12) United States Patent
Pfeiffer et al.

(10) Patent No.: US 11,808,150 B2
(45) Date of Patent: Nov. 7, 2023

(54) SYSTEM AND METHOD FOR FLUID SEPARATION

(71) Applicant: Schlumberger Technology Corporation, Sugar Land, TX (US)

(72) Inventors: Thomas Pfeiffer, Katy, TX (US); Ashers Partouche, Katy, TX (US); Kai Hsu, Sugar Land, TX (US); Simon Edmundson, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 17/663,473

(22) Filed: May 16, 2022

(65) Prior Publication Data

US 2022/0275725 A1 Sep. 1, 2022

Related U.S. Application Data

(63) Continuation of application No. 16/838,718, filed on Apr. 2, 2020, now Pat. No. 11,333,017.

(60) Provisional application No. 62/828,537, filed on Apr. 3, 2019.

(51) Int. Cl.

| | |
|---|---|
| ***E21B 49/08*** | (2006.01) |
| ***E21B 49/10*** | (2006.01) |
| ***E21B 43/38*** | (2006.01) |

(52) U.S. Cl.

CPC ..... *E21B 49/088* (2013.01); *E21B 43/38* (2013.01); *E21B 49/10* (2013.01); *E21B 49/0875* (2020.05)

(58) Field of Classification Search

CPC ..... E21B 49/088; E21B 49/10; E21B 43/38

See application file for complete search history.

(56) References Cited

U.S. PATENT DOCUMENTS

| | | | |
|---|---|---|---|
| 3,273,647 | A | 9/1966 | Briggs, Jr. |
| 5,644,076 | A | 7/1997 | Proett et al. |
| 5,741,962 | A | 4/1998 | Birchak et al. |
| 7,195,063 | B2 | 3/2007 | Nogueira et al. |
| 8,215,388 | B2 | 7/2012 | van Zuilekom et al. |
| 10,895,663 | B2 | 1/2021 | Hashem et al. |
| 2005/0082059 | A1 | 4/2005 | Nogueira et al. |
| 2007/0114021 | A1 | 5/2007 | Brown et al. |

(Continued)

FOREIGN PATENT DOCUMENTS

| | | | |
|---|---|---|---|
| WO | 2018165095 | A1 | 9/2018 |
| WO | 2020112131 | A1 | 6/2020 |

OTHER PUBLICATIONS

OKeefe, M. D. et al., "Focused Sampling of Reservoir Fluids Achieves Undetectable Levels of Contamination", SPE-101084-PA, SPE Reservoir Evaluation Engineering, 2008, 11(2), 14 pages.

*Primary Examiner* — Jennifer H Gay

(74) *Attorney, Agent, or Firm* — Frederick Carbone

(57) ABSTRACT

This disclosure relates to a separating a fluid having multiple phases during formation testing. For example, certain embodiments of the present disclosure relate to receiving contaminated formation fluid on a first flow line and separating a contamination (e.g., mud filtrate) from the formation fluid by diverting the relatively heavier and/or denser fluid (e.g., the mud filtrate) downward through a second flow line and diverting the relatively lighter and/or less dense fluid upward through a third flow line. In some embodiments, the third flow line is generally oriented upwards at a height that may facilitate the separation of the heavier fluid from the relatively lighter fluid based on gravity and/or pumps.

18 Claims, 6 Drawing Sheets

(56) References Cited

U.S. PATENT DOCUMENTS

| | | | |
|---|---|---|---|
| 2010/0089569 | A1 | 4/2010 | van Zuilekom et al. |
| 2012/0285680 | A1 | 11/2012 | Kumar |
| 2014/0361155 | A1 | 12/2014 | Daito et al. |
| 2019/0284919 | A1 | 9/2019 | Jones et al. |
| 2020/0318477 | A1 | 10/2020 | Pfeiffer et al. |
| 2020/0379139 | A1 | 12/2020 | Hashem et al. |
| 2020/0400017 | A1 | 12/2020 | Olapade et al. |
| 2020/0400858 | A1 | 12/2020 | Olapade et al. |
| 2021/0054737 | A1 | 2/2021 | Dai et al. |
| 2021/0095561 | A1 | 4/2021 | Al-Malki et al. |
| 2021/0246785 | A1 | 8/2021 | Jones et al. |

SYSTEM AND METHOD FOR FLUID SEPARATION

CROSS-REFERENCE TO RELATED APPLICATIONS

Any and all applications for which a foreign or domestic priority claim is identified in the Application Data Sheet as filed with the present application are hereby incorporated by reference under 37 CFR 1.57. The present application is a continuation application of U.S. patent application Ser. No. 16/838,718, filed Apr. 2, 2020, which claim benefit of U.S. Provisional Application No. 62/828,537, filed Apr. 3, 2019, the entirety of which are incorporated by reference herein and should be considered part of this specification.

BACKGROUND

This disclosure relates generally to downhole tools and more specifically to tools for separating fluids during formation testing.

Reservoir fluid analysis may be used to better understand a hydrocarbon reservoir in a geological formation. Indeed, reservoir fluid analysis may be used to measure and model fluid properties within the reservoir to determine a quantity and/or quality of formation fluids—such as liquid and/or gas hydrocarbons, condensates, drilling muds, and so forth—that may provide much useful information about the reservoir. This may allow operators to better assess the economic value of the reservoir, obtain reservoir development plans, and identify hydrocarbon production concerns for the reservoir.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In one embodiment, the present techniques are related to phase separation within a formation testing tool. In some embodiments, the present techniques may be utilized as an alternative to focused sampling. In some embodiments, the present techniques may be applied in cases where the mud filtrate and the formation fluid are two distinct fluid phases of different density. In some embodiments, aspects of the present disclosure may relate to tools having double flow line architecture. Both phases enter the tool simultaneously into the same flow line. The phases are then split up and routed each to a different flow line.

Various refinements of the features noted above may be undertaken in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended only to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which.

DETAILED DESCRIPTION

Figure 1:
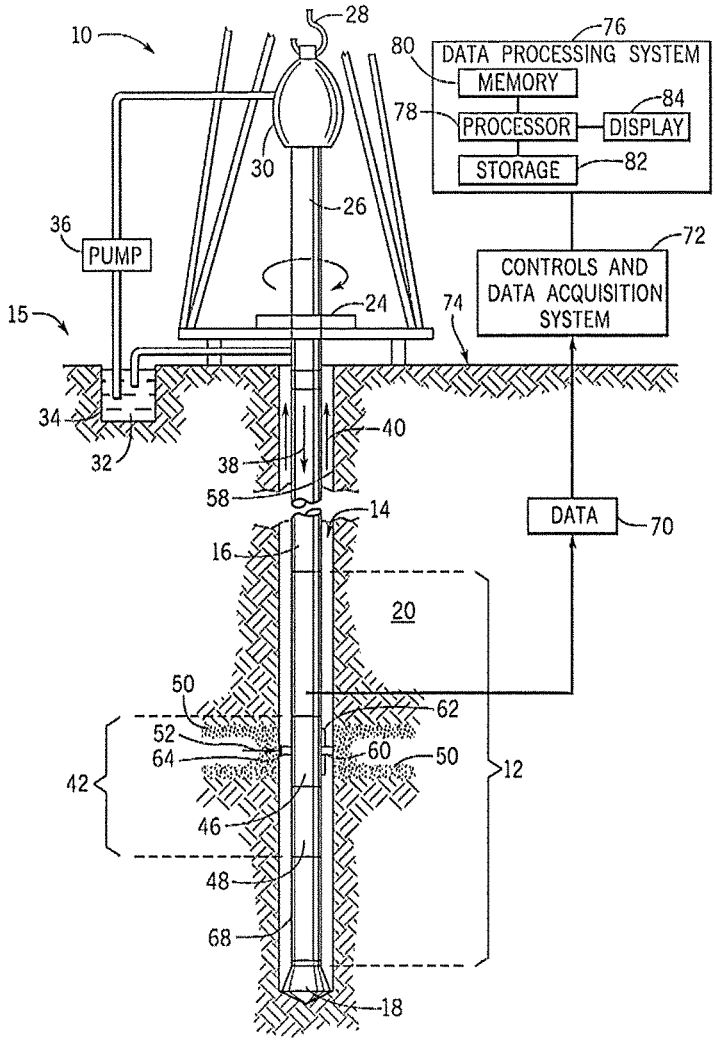
FIG. 1 is a partial cross sectional view of a drilling system used to drill a well through subsurface formations, in accordance with an embodiment of the present techniques.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

Formation testing provides information about the properties of a subsurface formation such as the minimum horizontal stress, which may be useful for optimizing the extraction of oil and gas from a subsurface formation. During formation testing, a downhole tool is inserted into a wellbore and formation fluid is withdrawn from the subsurface formation. The subsurface formations are accessed by wells drilled with a drilling fluid (e.g., drilling mud or mud filtrate). Part of the drilling fluid may displace a portion of formation fluid around the wellbore in permeable rock formations. During operation, the mud filtrate may contaminate the formation fluid, and the mud filtrate may be separated or removed during operating to capture and measure pure formation fluid.

In some instances, drilling fluid, such as mud filtrate, may not be miscible with the formation fluid. Certain conventional techniques for mud filtrate contaminant from formation fluid involve pumping the contaminated formation fluid (e.g., formation fluid with mud filtrate) into a sample chamber and waiting for the mud filtrate to separate from the formation fluid. Such techniques may not allow for a continuous evaluation of formation fluid from the subsurface formation.

Accordingly, the present disclosure provides an efficient solution to phase separation that may be used as an alternative or in addition to certain conventional techniques, such as focused sampling. Aspects in accordance with the present disclosure may be applied to, for example, cases where the mud filtrate and the formation fluid are two distinct fluid phases of different density. Embodiments of the present disclosure may include downhole tools with double flow line architecture, where both phases enter the tool into the same flow line and the phases are subsequently split up and routed each to a different flow line.

For example, certain embodiments of the present disclosure relate to receiving contaminated formation fluid on a first flow line and separating a contamination (e.g., mud filtrate) from the formation fluid by diverting the relatively heavier and/or denser fluid (e.g., the mud filtrate) downward through a second flow line and diverting the relatively lighter and/or less dense fluid upward through a third flow line. In some embodiments, the third flow line is generally oriented upwards at a height that may facilitate the separation of the heavier fluid from the relatively lighter fluid based on gravity and/or pumps. Another embodiment of the present disclosure includes directing the contaminated formation fluid into a sample chamber and pumping a relatively less dense fluid (e.g., the formation fluid) from the top of the sample chamber and pumping a relatively denser fluid (e.g., mud filtrate) from a bottom of the sample chamber. A further embodiment of the present disclosure includes directing the contaminated formation fluid to one or more containers (e.g., bottles) whereby the contaminate fluid is separated based on the relative weights of the phases of the fluids.

Figure 2:
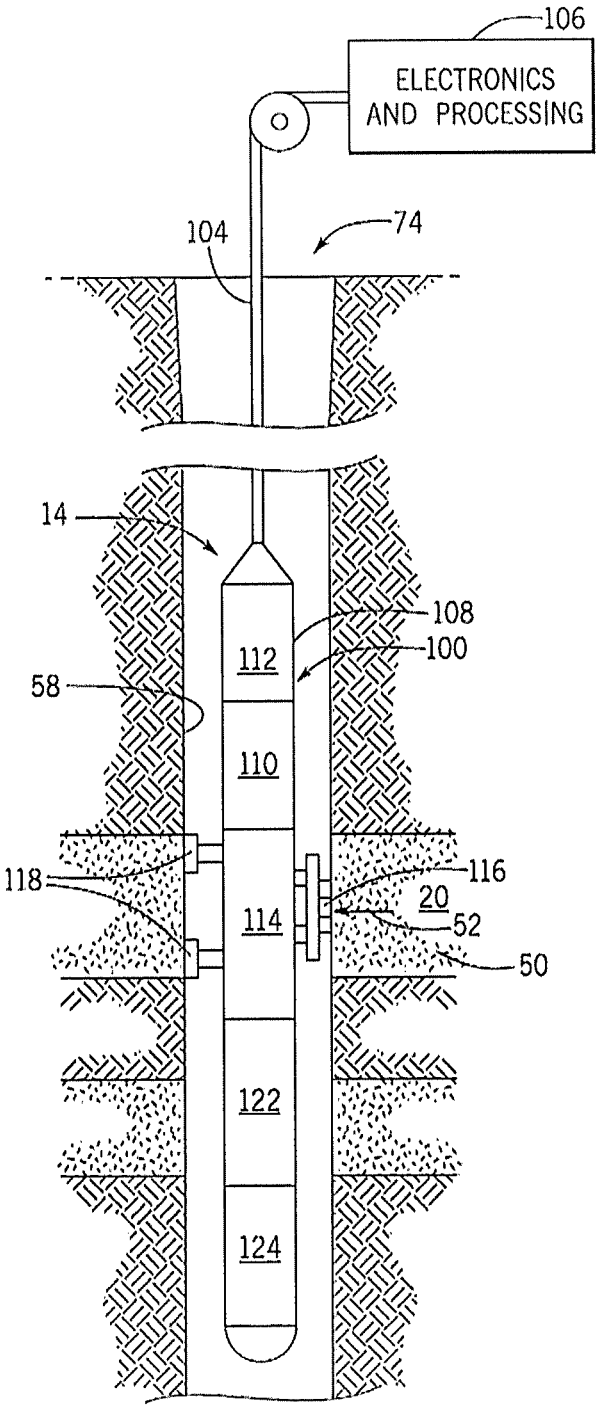
FIG. 2 is a schematic diagram of downhole equipment having various testing modules used to determine one or more characteristics of the subsurface formation, in accordance with an embodiment of the present techniques.

With the foregoing in mind, FIGS. 1 and 2 depict examples of wellsite systems that may employ the formation tester and techniques described herein. FIG. 1 depicts a rig 10 with a downhole acquisition tool 12 suspended therefrom and into a wellbore 14 of a reservoir 15 via a drill string 16. The downhole acquisition tool 12 has a drill bit 18 at its lower end thereof that is used to advance the downhole acquisition tool 12 into geological formation 20 and form the wellbore 14. The drill string 16 is rotated by a rotary table 24, energized by means not shown, which engages a kelly 26 at the upper end of the drill string 16. The drill string 16 is suspended from a hook 28, attached to a traveling block (also not shown), through the kelly 26 and a rotary swivel 30 that permits rotation of the drill string 16 relative to the hook 28. The rig 10 is depicted as a land-based platform and derrick assembly used to form the wellbore 14 by rotary drilling. However, in other embodiments, the rig 10 may be an offshore platform.

Formation fluid or mud 32 (e.g., oil base mud (OBM) or water-based mud (WBM)) is stored in a pit 34 formed at the well site. A pump 36 delivers the formation fluid 52 to the interior of the drill string 16 via a port in the swivel 30, inducing the drilling mud 32 to flow downwardly through the drill string 16 as indicated by a directional arrow 38. The formation fluid exits the drill string 16 via ports in the drill bit 18, and then circulates upwardly through the region between the outside of the drill string 16 and the wall of the wellbore 14, called the annulus, as indicated by directional arrows 40. The drilling mud 32 lubricates the drill bit 18 and carries formation cuttings up to the surface as it is returned to the pit 34 for recirculation.

The downhole acquisition tool 12, sometimes referred to as a bottom hole assembly ("BHA"), may be positioned near the drill bit 18 and includes various components with capabilities, such as measuring, processing, and storing information, as well as communicating with the surface. A telemetry device (not shown) also may be provided for communicating with a surface unit (not shown). As should be noted, the downhole acquisition tool 12 may be conveyed on wired drill pipe, a combination of wired drill pipe and wireline, or other suitable types of conveyance.

In certain embodiments, the downhole acquisition tool 12 includes a downhole analysis system. For example, the downhole acquisition tool 12 may include a sampling system 42 including a fluid communication module 46 and a sampling module 48. The modules may be housed in a drill collar for performing various formation evaluation functions, such as pressure testing and fluid sampling, among others. As shown in FIG. 1, the fluid communication module 46 is positioned adjacent the sampling module 48; however the position of the fluid communication module 46, as well as other modules, may vary in other embodiments. Additional devices, such as pumps, gauges, sensor, monitors or other devices usable in downhole sampling and/or testing also may be provided. The additional devices may be incorporated into modules 46, 48 or disposed within separate modules included within the sampling system 42.

The downhole acquisition tool 12 may evaluate fluid properties of reservoir fluid 50. Accordingly, the sampling system 42 may include sensors that may measure fluid properties such as gas-to-oil ratio (GOR), mass density, optical density (OD), composition of carbon dioxide ($CO_2$), $C_1$, $C_2$, $C_3$, $C_4$, $C_5$, and $C_{6+}$, formation volume factor, viscosity, resistivity, fluorescence, American Petroleum Institute (API) gravity, and combinations thereof of the reservoir fluid 50. The fluid communication module 46 includes a probe 60, which may be positioned in a stabilizer blade or rib 62. The probe 60 includes one or more inlets for receiving the formation fluid 52 and one or more flowlines (not shown) extending into the downhole acquisition tool 12 for passing fluids (e.g., the reservoir fluid 50) through the tool. In certain embodiments, the probe 60 may include a single inlet designed to direct the reservoir fluid 50 into a flowline within the downhole acquisition tool 12. Further, in other embodiments, the probe 60 may include multiple inlets that may, for example, be used for focused sampling. In these embodiments, the probe 60 may be connected to a sampling flowline, as well as to guard flowlines. The probe 60 may be movable between extended and retracted positions for selectively engaging the wellbore wall 58 of the wellbore 14 and acquiring fluid samples from the geological formation 20. One or more setting pistons 64 may be provided to assist in positioning the fluid communication device against the wellbore wall 58.

In certain embodiments, the downhole acquisition tool 12 includes a logging while drilling (LWD) module 68. The module 68 includes a radiation source that emits radiation (e.g., gamma rays) into the formation 20 to determine formation properties such as, e.g., lithology, density, formation geometry, reservoir boundaries, among others. The gamma rays interact with the formation through Compton scattering, which may attenuate the gamma rays. Sensors within the module 68 may detect the scattered gamma rays and determine the geological characteristics of the formation 20 based at least in part on the attenuated gamma rays.

The sensors within the downhole acquisition tool 12 may collect and transmit data 70 (e.g., log and/or DFA data) associated with the characteristics of the formation 20 and/or the fluid properties and the composition of the reservoir fluid 50 to a control and data acquisition system 72 at surface 74, where the data 70 may be stored and processed in a data processing system 76 of the control and data acquisition system 72.

The data processing system 76 may include a processor 78, memory 80, storage 82, and/or display 84. The memory 80 may include one or more tangible, non-transitory, machine readable media collectively storing one or more sets of instructions for operating the downhole acquisition tool 12, determining formation characteristics (e.g., geometry, connectivity, minimum horizontal stress, etc.) calculating and estimating fluid properties of the reservoir fluid 50, modeling the fluid behaviors using, e.g., equation of state models (EOS). The memory 80 may store reservoir modeling systems (e.g., geological process models, petroleum systems models, reservoir dynamics models, etc.), mixing rules and models associated with compositional characteristics of the reservoir fluid 50, equation of state (EOS) models for equilibrium and dynamic fluid behaviors (e.g., biodegradation, gas/condensate charge into oil, $CO_2$ charge into oil, fault block migration/subsidence, convective currents, among others), and any other information that may be used to determine geological and fluid characteristics of the formation 20 and reservoir fluid 52, respectively. In certain embodiments, the data processing system 54 may apply filters to remove noise from the data 70.

To process the data 70, the processor 78 may execute instructions stored in the memory 80 and/or storage 82. For example, the instructions may cause the processor to compare the data 70 (e.g., from the logging while drilling and/or downhole analysis) with known reservoir properties estimated using the reservoir modeling systems, use the data 70 as inputs for the reservoir modeling systems, and identify geological and reservoir fluid parameters that may be used for exploration and production of the reservoir. As such, the memory 80 and/or storage 82 of the data processing system 76 may be any suitable article of manufacture that can store the instructions. By way of example, the memory 80 and/or the storage 82 may be ROM memory, random-access memory (RAM), flash memory, an optical storage medium, or a hard disk drive. The display 84 may be any suitable electronic display that can display information (e.g., logs, tables, cross-plots, reservoir maps, etc.) relating to properties of the well/reservoir as measured by the downhole acquisition tool 12. It should be appreciated that, although the data processing system 76 is shown by way of example as being located at the surface 74, the data processing system 76 may be located in the downhole acquisition tool 12. In such embodiments, some of the data 70 may be processed and stored downhole (e.g., within the wellbore 14), while some of the data 70 may be sent to the surface 74 (e.g., in real time). In certain embodiments, the data processing system 76 may use information obtained from petroleum system modeling operations, ad hoc assertions from the operator, empirical historical data (e.g., case study reservoir data) in combination with or lieu of the data 70 to determine certain parameters of the reservoir 8.

FIG. 2 depicts an example of a wireline downhole tool 100 that may employ the systems and techniques described herein to determine formation and fluid property characteristics of the reservoir 15. The wireline downhole tool 100 is suspended in the wellbore 14 from the lower end of a multi-conductor cable 104 that is spooled on a winch at the surface 74. Similar to the downhole acquisition tool 12, the wireline downhole tool 100 may be conveyed on wired drill pipe, a combination of wired drill pipe and wireline, or other suitable types of conveyance. The cable 104 is communicatively coupled to an electronics and processing system 106. The wireline downhole tool 100 includes an elongated body 108 that houses modules 110, 112, 114, 122, and 124 that provide various functionalities including imaging, fluid sampling, fluid testing, operational control, and communication, among others. For example, the modules 110 and 112 may provide additional functionality such as fluid analysis, resistivity measurements, operational control, communications, coring, and/or imaging, among others.

As shown in FIG. 2, the module 114 is a fluid communication module 114 that has a selectively extendable probe 116 and backup pistons 118 that are arranged on opposite sides of the elongated body 108. The extendable probe 116 is configured to selectively seal off or isolate selected portions of the wall 58 of the wellbore 14 to fluidly couple to the adjacent geological formation 20 and/or to draw fluid samples from the geological formation 20. The extendable probe 116 may include a single inlet or multiple inlets designed for guarded or focused sampling. The reservoir fluid 50 may be expelled to the wellbore through a port in the body 108 or the formation fluid 50 may be sent to one or more modules 122 and 124. The modules 122 and 124 may include sample chambers that store the reservoir fluid 50. In the illustrated example, the electronics and processing system 106 and/or a downhole control system are configured to control the extendable probe 116 and/or the drawing of a fluid sample from the formation 20 to enable analysis of the fluid properties of the reservoir fluid 50, as discussed above.

In some embodiments, the module 114 may be used for formation testing. For example, one or more of the extendable probes 116 may be used to pump fluid from the formation, measure and/or take samples of the fluid after the pumped fluid becomes sufficiently clean (i.e. drilling fluid contamination level below a threshold). Sometimes, the one or more of the extendable probes 116 may be used to inject a fluid into the geological formation 20 until a fracture forms. After the fracture forms, resulting in the release of flowback fluid or formation fluid 52 from the formation, one or more of the extendable probes 116 receive the fluid. The extendable probes 116 receiving the fluid may be coupled to one or more formation testing module 122 and/or 124, which determine a property of the formation.

Figure 3:
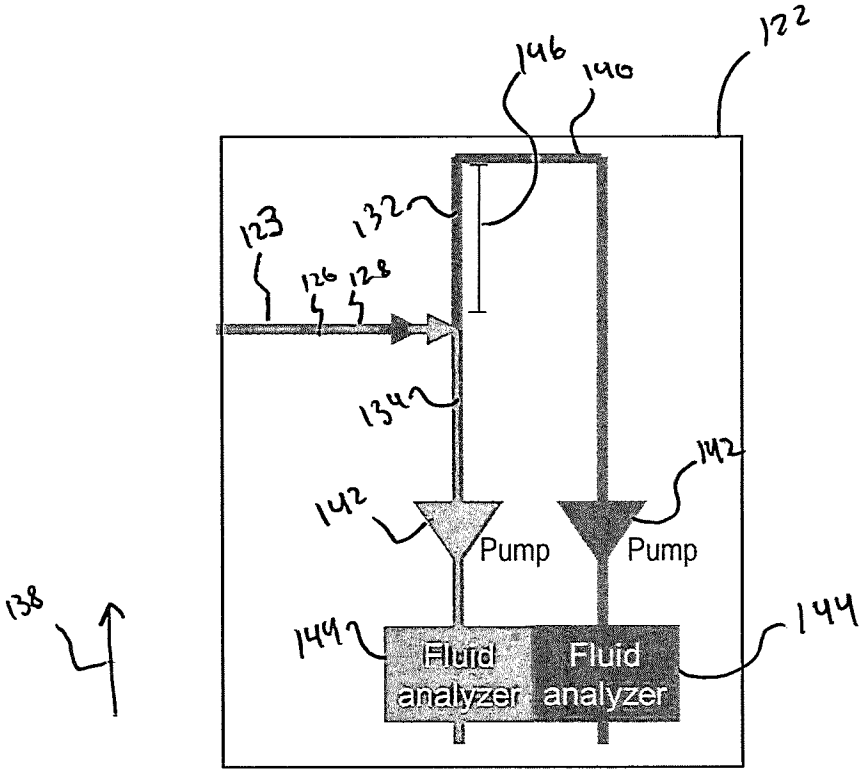
FIG. 3 is a schematic diagram of an embodiment of a formation testing module for a downhole tool that includes multiple vertical flow lines, in accordance with an embodiment.

FIG. 3 is a schematic diagram of an embodiment of the formation testing module 122 of the downhole tool 100. In the illustrated embodiment, the formation testing module 122 includes a flow line 123 that directs a flow including formation fluid 126 and a contaminant fluid 128 to a junction 130 of a first vertical flow line 132 and a second vertical flow line 134 with the flow line 123. It should be noted that the flow line 123 may directly receive the fluid from the formation, or may receive the formation fluid via the extendable probes 116.

In general, the illustrated embodiment of the formation testing module 122 of FIG. 3 separates formation fluid 126 from a contaminant fluid 128 along the flow line due to the relative weights of the formation fluid 126 and the contaminant fluid 128. In this illustrated embodiments, the contaminant fluid 128 is a relatively heavier fluid phase and is routed generally downward (e.g., opposite of the direction indicated by the arrow 138) along the second vertical flow line 134 and away from the junction 130. The formation fluid 126, which in this illustration is the relatively lighter phase, is routed generally upward (e.g., in the direction of the arrow 138) against gravity and along the first vertical flow line 132 before it is routed into a second flow line 140.

In some embodiments, the first vertical flow line 132 and the second vertical flow line 134 may include individual pumps 142 that control the flow rate of each phase through the respective vertical flow lines. Additionally, the formation testing module 122 includes fluid analyzers 144 that measure one or more fluid properties. In some embodiments, the pump flow rates may be adjusted to optimize the separation of the phases based on data acquired by the analyzers (e.g., received by the controls and data acquisition system 72, or any suitable processor) so that, for example, the operator can evaluate how effective the separation is. For example, if the fluid analyzer indicates evidence that the contaminant fluid 128 is present in the first vertical flow line of the light phase, the pump of the heavier phase is accelerated until the heavy phase disappears in that line. It should be noted that this process may be automated.

The height 146 at which the formation fluid 126 is routed to the second flow line 140 (e.g., along the first vertical flow line 132) may be fixed or varied by, for example, providing a U-turn connection between the first vertical flow line 132 and the second flow line 140, such as higher up in the toolstring. This may provide better separation at higher flow rates and less sensitivity to changes in phase hold up.

Figure 4B:
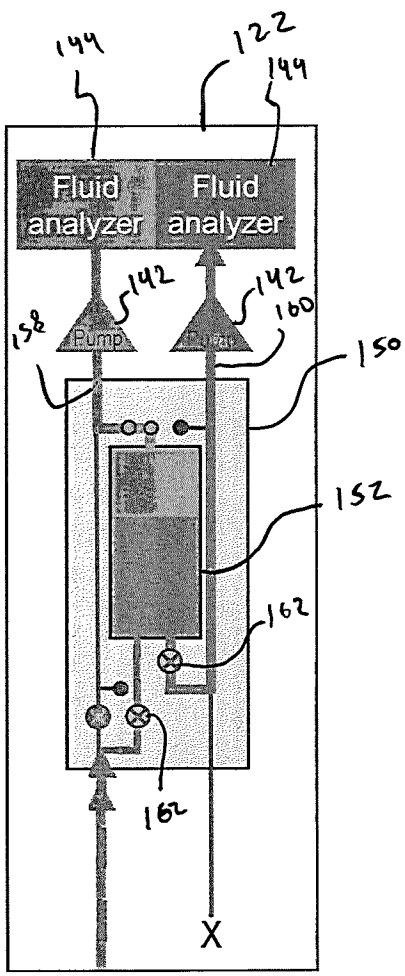
FIG. 4B is a schematic diagram of another embodiment of a formation testing module for a downhole tool that includes a fluid sample chamber that may receive a contaminated formation fluid, in accordance with an embodiment of the present techniques.
Figure 4A:
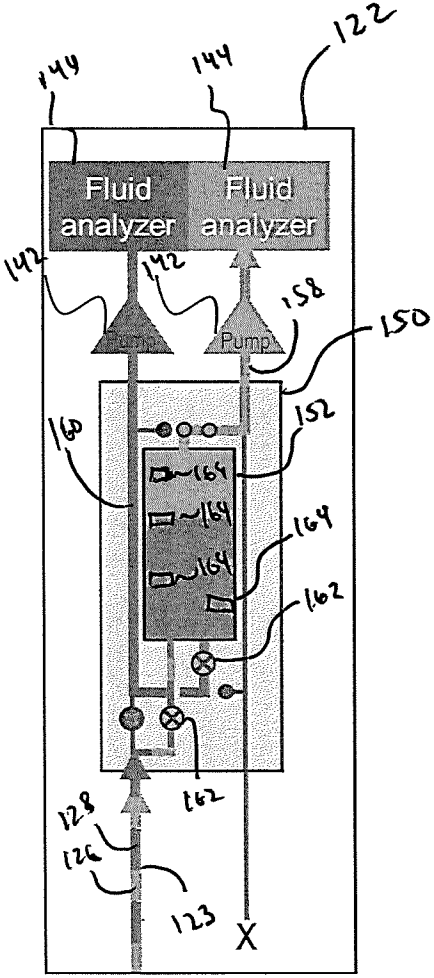
FIG. 4A is a schematic diagram of an embodiment of a formation testing module for a downhole tool that includes a fluid sample chamber that may receive a contaminated formation fluid, in accordance with an embodiment of the present techniques.

FIG. 4A is a schematic diagram of an embodiment of a formation testing module 122 of the downhole tool 100 that includes a separation chamber 150 having a sample vessel 152 that is fluidly coupled to the flow line 123. In operation, the flow line 123 may direct a fluid mixture (e.g., having two phases of fluids) including the formation fluid 126 and a contaminant fluid 128 to the sample vessel 152, where the fluid mixture may be separated based on the relative densities of the fluids into a first portion 154 and a second portion 156. As shown in the illustrated embodiment of the formation testing module 122 of FIG. 4A, the first portion 154 may be directed in an upward direction (e.g., in the direction indicated by the arrow 138) along the flow line 158 to a fluid analyzer 144 via a pump 142. The second portion 156 may be directed in a downward direction (e.g., opposite of the direction indicated by the arrow 138) along the flow line 160 to a fluid analyzer 144 via a pump 142. FIG. 4B shows an example of another configuration of the formation testing module 122 shown in FIG. 4A.

It should be noted that the illustrated embodiment of the formation testing modules 122 of FIGS. 4A and 4B may provide continuous flow through the separation chamber 150 to separate the fluid phases. In some embodiments, both phases may enter the chamber simultaneously as they come from the formation and segregate by gravity. For example, the relatively less dense fluid is pumped out via the flow line 158 that is fluidly coupled to a top of the sample vessel 152 and directed to a fluid analyzer 144, and the relatively more dense fluid may be pumped out via the flow line 160 to the a fluid analyzer 144 via a pump 122.

In some embodiments, valves 163 may be disposed along the flow line 123, 158, and 160 to selectively couple the fluids into the sample vessel 152 and the flow lines 158 and 160. Evaluation of the fluid properties in the fluid analyzers may provide an operator a way to gauge the efficiency of the separation of the two fluids, which in turn, may be used to modify operation of, for example, the pump flow rates. At least in some instances, the use of the separation chamber 150 may provide the formation testing module 122 the ability to support higher flow rates compared to the illustrated embodiment of the formation testing module of FIG. 3, where the fluids segregate in the flow line. For example, the larger cross-sectional area and the longer retention time in the chamber may help to segregate certain fluid phases at higher rates. In some embodiments, baffles 164, such as metal inserts, maybe placed into the sample vessel 152 to facilitate segregation and to separate the fluids more efficiently. Several exemplary positions of the baffles 164 are shown in FIG. 4A. This method may provide continuous separation by controlling the fluid interface in the separation chamber.

Figure 5:
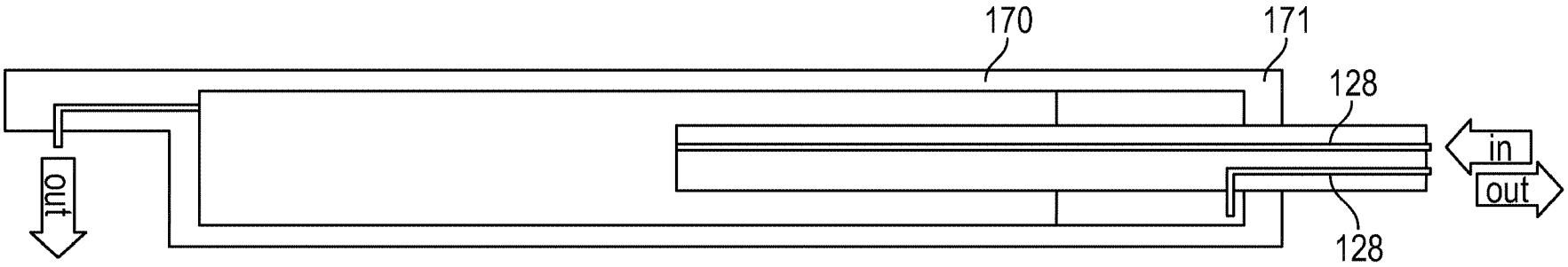
FIG. 5 is a schematic diagram of a bottle that may be used to store and separate contaminated formation fluid, in accordance with an embodiment of the present techniques.

As discussed herein, in some embodiments, the contaminated formation fluid may be directed to one or more containers (e.g., bottles) via flow lines, whereby the contaminate fluid is separated based on the relative weights of the phases of the fluids. FIG. 5 is a schematic diagram of a bottle 170 that may be disposed in a formation test module 122 to facilitate separation of phases of formation fluid, as discussed herein. In some embodiments, the bottle 170 may be a fluid sampling bottle that is modified by removing certain internal parts such as pistons and rod locks. In some embodiments, the flow line stabber is modified to provide one line to reach mid-way into the bottle and the second line to return from the bottles close to the bottle head 171.

Figure 6B:
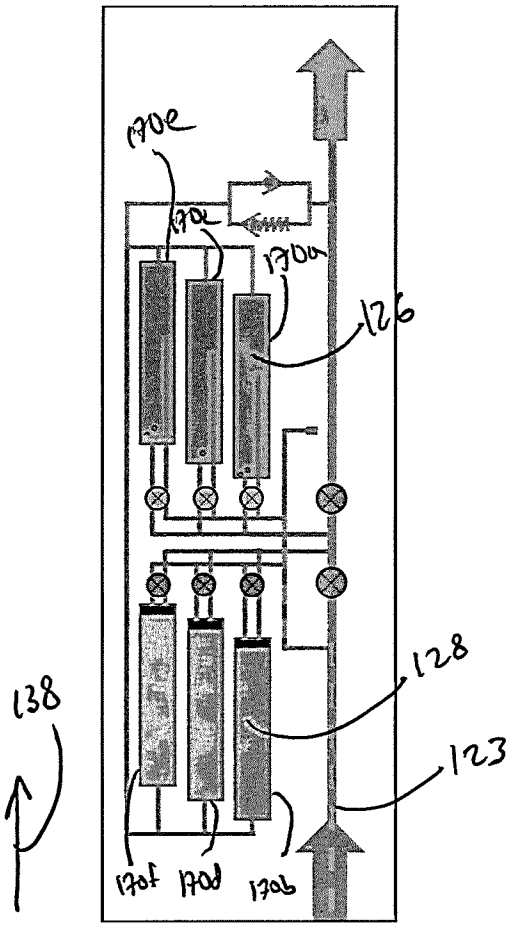
FIG. 6B is a schematic diagram of another embodiment of a formation testing module for a downhole tool that includes the bottle of FIG. 5, in accordance with an embodiment of the present techniques.
Figure 6A:
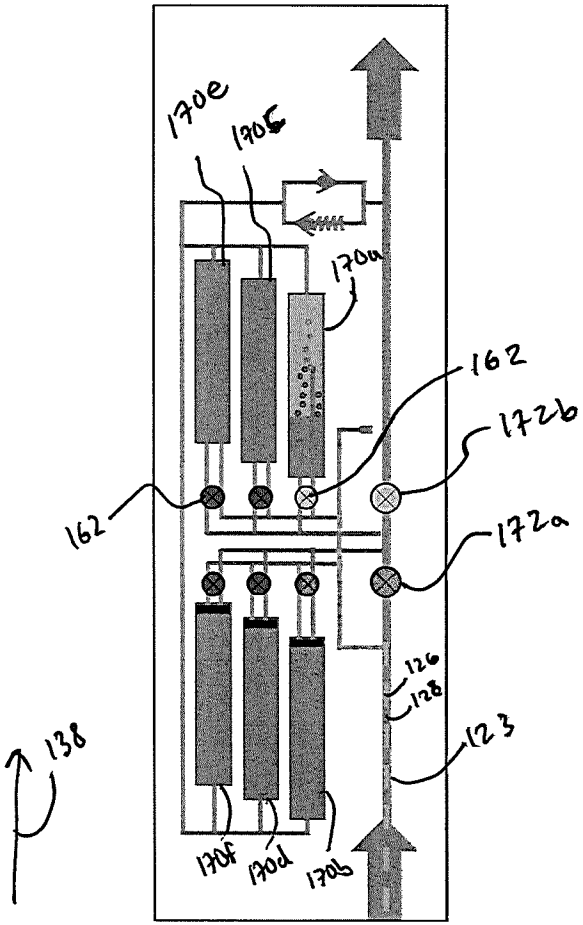
FIG. 6A is a schematic diagram of another embodiment of a formation testing module for a downhole tool that includes the bottle of FIG. 5, in accordance with an embodiment of the present techniques.

FIG. 6A is a schematic diagram of an embodiment of the formation testing module 122 of the downhole tool 100 that includes multiple bottles 170 that are fluidly coupled to the flow line 123. In general, each bottle 170 is selectively coupled to the flow line 123 and the other bottles 170 via valves 162.

In operation, the fluid mixture including formation fluid 126 and contaminant fluid 128 may be separated selectively on a single flow line 123. In some embodiments, the illustrated embodiment of the formation testing module of FIG. 6A may be operated in a non-continuous, such as being performed in two steps as discussed further below. In general, the method uses a first bottle (which can be a bottle carrier in some embodiments) and a second bottle, such as the bottle shown in FIG. 5, as separation chambers. As shown in the illustrated embodiment of the formation testing module 122 of FIG. 6A, the formation testing module 122 includes three modified bottles 170*b*, 170*d*, and 170*f* that are disposed in the upper bank (bottle head facing down) of the bottle carrier to capture the light phase. Alternatively, the bottles may be placed in the lower bank (bottle head facing up) to capture the heavy phase.

It should be noted that when pumping out from the formation, two phases (e.g., formation fluid 126 and contaminant fluid 128) may enter the flow line of the sampling module. In some embodiments, the sampling module carrying the separator bottles may be placed between the inlet and the pumps. This process may then repeat for the other bottles 170*c* and 170*e*. For example, a second module (e.g., bottle 170*c*) may be placed higher up (e.g., in the direction indicated by the arrow 138) in the string to capture the separated formation fluid. The flow of the separated formation fluid can be diverted through the separator bottles by closing the lower seal valve 172*a*. The phases may separate in the bottles FIG. 6A. The heavier phase may exit the bottle at the bottle head until the bottle is full of the lighter phase. When the separator bottle is at least partially filled with the desired phase, a second separator bottle may be opened until it is filled with the lighter phase. After the third separator bottle has been filled with the lighter phase in the same manner, the upper seal valve 172*b* may be closed. The pump may now pump from the top of the separator bottles, only skimming off the lighter phase. FIG. 6B illustrates an example of the formation testing module 122 after three bottles 170 have been filled with volumes of formation fluid 126. The separation bottles may be placed in the lower bank of the sampling module, for example, if the operator desires to capture the heavier phase. The flow may be diverted through the separator bottles until these are full of the heavy phase. In a next step the desired phase may transferred from the separator bottles to a sealing sample capture bottle.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

The invention claimed is:

1. A downhole acquisition tool, comprising:

a formation testing module comprising:

a first flow line fluidly coupled to a geological formation and configured to receive a contaminated formation fluid from the geological formation, wherein the contaminated formation fluid comprises a formation fluid and a contamination, and wherein the contamination has a greater density than the formation fluid;

a second flow line fluidly coupled to the first flow line, wherein the second flow line is configured to receive a first portion of the contaminated formation fluid and direct the first portion of the contaminated formation fluid in a first direction, wherein at least a portion of the first portion of the contaminated formation fluid comprises the contamination, and wherein the first direction is downward;

a third flow line fluidly coupled to the first flow line and the second flow line, wherein the third flow line is configured to receive a second portion of the contaminated formation fluid and direct the second portion of the contaminated formation fluid in a second direction, wherein at least a portion of the second portion of the contaminated formation fluid comprises the formation fluid; and a first pump fluidly coupled to one of the second flow line or the third flow line, wherein the first pump is configured to control a flow of the first portion of the contaminated formation fluid within the second flow line, the second portion of the contaminated formation fluid within one of the third flow line, or both.

2. The downhole acquisition tool of claim 1, further comprising:

a separation chamber fluidly coupled to the first flow line, the second flow line, and the third flow line.

3. The downhole acquisition tool of claim 1, wherein the second direction is an upward direction.

4. The downhole acquisition tool of claim 2, wherein the separation chamber includes one or more baffles.

5. The downhole acquisition tool of claim 1, wherein a majority of the first portion of the contaminated formation fluid in the second flow line comprises the contamination, and wherein a majority of the second portion of the contaminated formation fluid in the third flow line comprises the formation fluid.

6. The downhole acquisition tool of claim 1, further comprising:

a second pump fluidly coupled to one of the second flow line or the third flow line, wherein the second pump is configured to control a flow of the first portion of the contaminated formation fluid within the second flow line, the second portion of the contaminated formation fluid within one of the third flow line, or both.

7. The downhole acquisition tool of claim 6, wherein:

the first pump is fluidly coupled to the second flow line;

the first pump is configured to control a flow of the first portion of the contaminated formation fluid within the second flow line;

the second pump is fluidly coupled to the third flow line; and the second pump is configured to control a flow of the second portion of the contaminated formation fluid within the third flow line.

8. The downhole acquisition tool of claim 1, further comprising:

a first fluid analyzer fluidly coupled to the first pump, the first fluid analyzer configured to measure one or more properties of one of the first portion of the contaminated formation fluid within the second flow line, the second portion of the contaminated formation fluid within one of the third flow line, or both.

9. The downhole acquisition tool of claim 8, wherein the first pump is configured to automatically adjust a fluid flow rate of the first portion of the contaminated formation fluid within the second flow line, the second portion of the contaminated formation fluid within one of the third flow line, or both, based on the one or more properties measured by the first fluid analyzer.

10. A method, comprising:

positioning a downhole acquisition tool comprising a formation testing module within a wellbore penetrating a geological formation;

receiving a contaminated formation fluid from the geological formation into a first flow line of the formation testing module, wherein the contaminated formation fluid comprises a formation fluid and a contamination, and wherein the contamination has a greater density than the formation fluid;

separating the contaminated formation fluid into a first portion and a second portion;

directing the first portion of the contaminated formation fluid into a second flow line fluidly coupled to the first flow line, wherein at least a portion of the first portion of the contaminated formation fluid comprises the contamination, wherein the first portion of the contaminated formation fluid is directed in a first direction, and wherein the first direction is downward;

directing the second portion of the contaminated formation fluid into a third flow line fluidly coupled to the first flow line and the second flow line; wherein at least a portion of the second portion of the contaminated formation fluid comprises the formation fluid, and wherein the second portion of the contaminated formation fluid is directed in a second direction; and controlling a flow of the first portion of the contaminated formation fluid within the second flow line, the second portion of the contaminated formation fluid within one of the third flow line, or both using a first pump.

11. The method of claim 10, wherein the contaminated formation fluid is separated within a separation chamber fluidly fluidly coupled to the first flow line, the second flow line, and the third flow line.

12. The method of claim 11, wherein the separation chamber includes one or more baffles.

13. The method of claim 10, wherein the second direction is an upward direction.

14. The method of claim 10, wherein a majority of the first portion of the contaminated formation fluid in the second flow line comprises the contamination, and wherein a majority of the second portion of the contaminated formation fluid in the third flow line comprises the formation fluid.

15. The method of claim 10, further comprising:

controlling a flow of the first portion of the contaminated formation fluid within the second flow line, the second portion of the contaminated formation fluid within one of the third flow line, or both using a second pump.

16. The method of claim 15, wherein:

the flow of the first portion of the contaminated formation fluid within the second flow line is controlled by the first pump; and the flow of the second portion of the contaminated formation fluid within the third flow line is controlled by the second pump.

17. The method of claim 10, further comprising:

measuring one or more properties of one of the first portion of the contaminated formation fluid within the second flow line, the second portion of the contaminated formation fluid within one of the third flow line, or both, using a first fluid analyzer fluidly coupled to the first pump.

18. The method of claim 17, further comprising:

automatically adjusting a fluid flow rate of the first portion of the contaminated formation fluid within the second flow line, the second portion of the contaminated formation fluid within one of the third flow line, or both, using the first pump based on the one or more properties measured by the first fluid analyzer.

* * * * *